United States Patent [19]

Davis

[11] Patent Number: 4,986,433

[45] Date of Patent: Jan. 22, 1991

[54] CRISPY CEREAL SERVING PIECE AND METHOD

[76] Inventor: Alton A. Davis, 4653 Buckline Cir., Dunwoody, Ga. 30338

[21] Appl. No.: 533,275

[22] Filed: Jun. 4, 1990

[51] Int. Cl.[5] ..... B65D 7/00

[52] U.S. Cl. ..... 220/23.8; 220/23.83; 206/564

[58] Field of Search ..... 220/23.8, 23.6, 23.83; 206/558, 564

[56] References Cited

U.S. PATENT DOCUMENTS

| | | | |
|---|---|---|---|
| 2,327,078 | 8/1943 | Teetor | 220/23.83 |
| 2,602,309 | 7/1952 | Doyle | 220/23.83 |
| 2,795,121 | 6/1957 | Dantguo | 220/23.83 |
| 2,906,427 | 9/1959 | Beuchler | 220/23.83 |
| 3,589,554 | 6/1971 | Smith | 220/23.83 |
| 3,972,438 | 8/1976 | Neville | 220/23.83 |

*Primary Examiner*—Joseph Man-Fu Moy
*Attorney, Agent, or Firm*—Thomas & Kerr

[57] ABSTRACT

A serving piece for serving cereal and preventing its becoming soggy in milk includes a lower bowl configured to be supported in a food containing orientation upon a surface. An elongated sloped chute is mounted to and communicates at one end with the lower bowl and extends upwardly and outwardly therefrom and an upper bowl is mounted to and communicates with the other end of the sloped chute. In use, crispy cereal from the upper bowl is urged in successive measured portions down the chute and into milk contained in the lower bowl from where each portion of cereal can be consumed prior to its becoming soggy.

10 Claims, 2 Drawing Sheets

CRISPY CEREAL SERVING PIECE AND METHOD

TECHNICAL FIELD

This invention relates to food service and particularly to a serving piece for serving breakfast cereal while preventing its becoming soggy in milk.

BACKGROUND OF THE INVENTION

Grain cereals in the form of crispy flakes, toasted bits and the like have long been preferred as breakfast food in modern society due at least in part to their good taste and relative ease of preparation. Such cereals are most often served by being poured from their storage box into a serving bowl whereupon milk and sometimes sugar or fruit is added to taste. The cereal and milk mixture is then usually eaten with a spoon or other utensil.

A common problem with such cereals arises from the tendency of their crispy flakes or toasted bits to absorb the added milk within the serving bowl thereby rendering the cereal soggy and undesirable. This is a particular problem for those who prefer a leisurely breakfast since the cereal is suspended in the milk for longer periods of time. Soggy cereal is so undesirable that many people will not eat it and simply discard the soggy cereal and its milk, which can be wasteful and costly.

Past attempts to solve the problem of soggy cereal have generally been directed to treatment of the cereal itself to reduce its tendency to absorb milk. While treatment has proven somewhat successful and has even lead to claims by some cereal manufactures that their cereal stays crisp in milk, it has not been a complete solution because the rate of milk absorption is only retarded by the treatment and the cereal eventually becomes soggy anyway. Further, cereal treatment usually involves coatings of sugar or other additives that are objectionable to many people who prefer a more natural untreated cereal. For this reason, cereals that claim to stay crisp in milk have generally been confined to the presweetened type usually marketed to children.

A continuing and heretofore unaddressed need exists therefore, for a method and apparatus of serving crispy cereal and milk that does not require coating or other treatment of the cereal but that nevertheless insures that the served cereal does not become soggy in its milk. It is the provision of a crispy cereal serving piece that embodies such a method to which the present invention is primarily directed.

SUMMARY OF THE INVENTION

The present invention is a crispy cereal serving piece that includes a lower bowl adapted to be supported on a surface in a food containing orientation. An elongated sloped cereal chute is mounted and communicates at one end with the lower bowl and extends upwardly and outwardly therefrom. An upper bowl is mounted to and communicates with the other end of the cereal chute with the upper bowl being supported by the chute in an elevated position relative to the lower bowl. The chute, therefore, communicates between the upper bowl and the lower bowl.

In use, the lower bowl is at least partially filled with milk and the upper bowl is filled with crispy cereal. A measured, quickly consumable portion of the cereal can then be urged with a spoon or other eating utensil from the upper bowl down the chute and into the milk from where it can be consumed before it absorbs sufficient quantities of milk to become soggy. Additional measured portions of cereal are then transferred from the upper bowl into the milk only as required insuring that cereal never stands in the milk long enough to become soggy and permitting all of the poured cereal to be fully enjoyed. Further, no coating or other treatment of the cereal is required since each measured portion of the cereal remains crispy in the upper bowl until just before being consumed and is only then introduced into the milk.

Thus, a unique serving piece for serving breakfast cereal and milk is now provided that insures the crispness of the cereal throughout even the most leisurely meal. Since the cereal is only introduced to the milk in measured portions just before consumption, no coating or other treatment of the cereal is required and even the most absorbent cereals are maintained in a fresh crisp condition throughout the meal. These and other objects, features and advantages of the invention will become more apparent upon review of the following detailed description taken in conjunction with the accompanying drawings.

DETAILED DESCRIPTION OF THE PREFERRED EMBODIMENT

Figure 1:
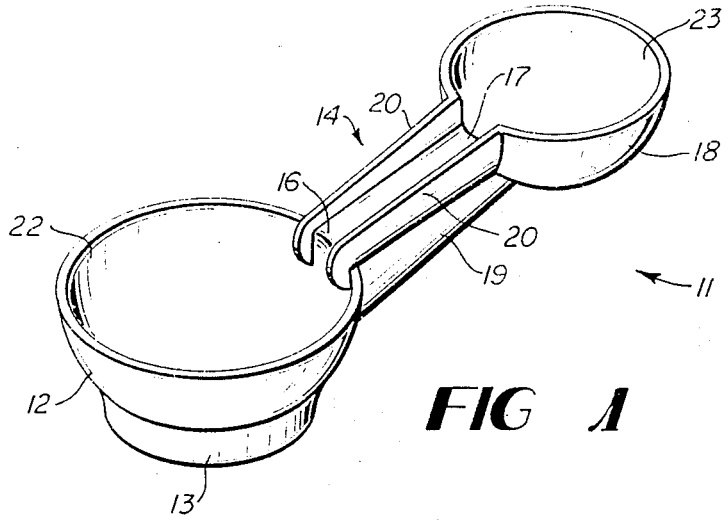
FIG. 1 is a perspective view of a cereal serving piece that embodies principles of the invention in a preferred form.
Figure 2:
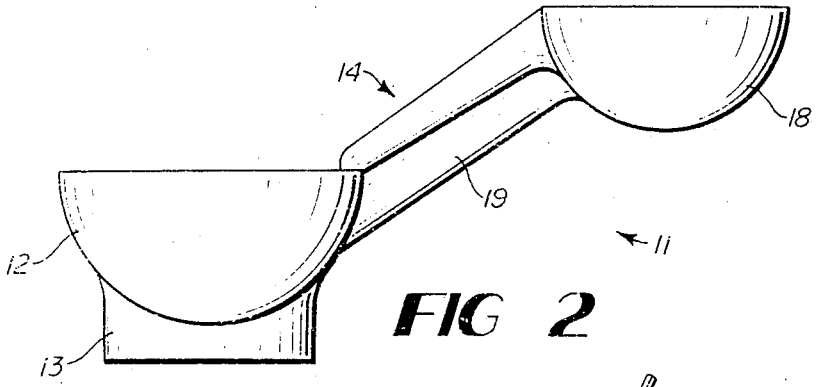
FIG. 2 is a side elevational view of the cereal serving piece of FIG. 1.
Figure 3:
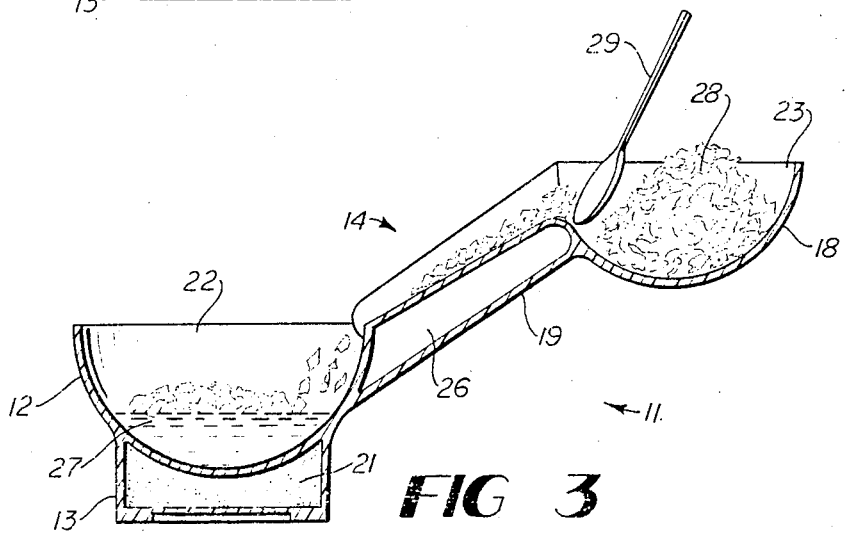
FIG. 3 is a longitudinal cross-sectional view of the serving piece of FIG. 1 showing preferred construction thereof.

Referring now in more detail to the drawings, in which like numerals refer to like parts throughout the several views, FIGS. 1 through 5 illustrate a crispy cereal serving piece 11 that embodies principles of the invention in a preferred form. The serving piece 11 is seen to include a lower reservoir in the form of a bowl 12 having a base 13 adapted to support the bowl in its upwardly open food containing orientation as shown. The base 13 is preferably formed to have a substantially cylindrical shape, although other configurations of the base might be chosen with comparable results.

An elongated sloped chute 14 is mounted to the bowl 12 with its lower end portion 16 communicating with the bowl 12 adjacent its rim and with the chute 14 extending upwardly and outwardly from the bowl 12 to an upper end portion 17. An upper receptacle in the form of a bowl 18 is mounted to and communicates with the chute 14 at its upper end portion 17 and a brace member 19 provides the chute 14 with rigidity and helps support the bowl 18 in its elevated position relative to the bowl 12.

The cylindrical base 13 is preferably hollow and filled with a weighted material such as, for example, sand 21 for increased stability of the serving piece 11 atop a surface. Specifically, the weighted base 13 helps to counteract the forces generated by the chute, upper bowl and any cereal therein to insure that the piece 11 does not tip over in use.

While the bowls 12 and 18 and the chute 14 can be formed in separate pieces and assembled if desired, it is preferable that the entire serving piece 11 be formed as a unitary object through an injection molding or other similar process. Such injection molded unitary construction lends itself conveniently to common mass production techniques and results in a high quality product at a reasonable cost.

Figure 4:
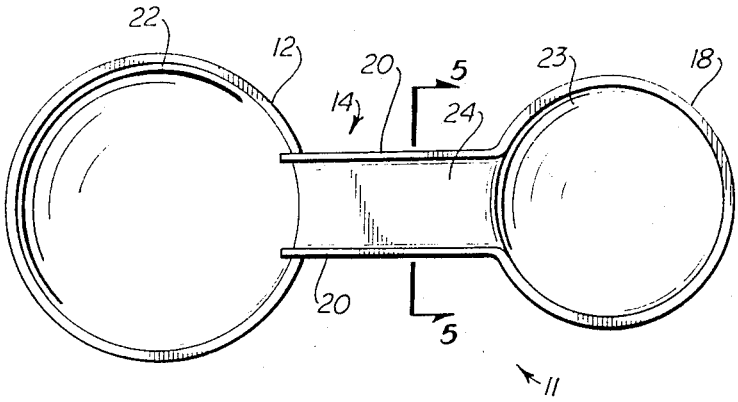
FIG. 4 is a top plan view of the cereal serving piece of FIG. 1.

FIG. 4 is a top plan view of the serving piece 11 showing the interior 22 of the lower bowl 12 and the interior 23 of the upper bowl 18. The chute 14 has a chute floor 24 bordered by generally upstanding walls 20 such that the chute 14 communicates between the upper bowl 18 and the lower bowl 12 for transferring crispy cereal therebetween as detailed below.

Figure 5:
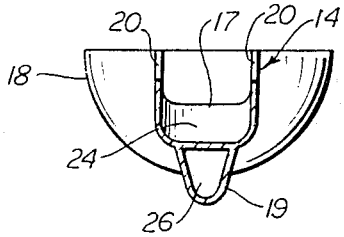
FIG. 5 is a cross-sectional view taken along line 5—5 of FIG. 4.

In FIG. 5, the chute 14 is seen to have a substantially U-shaped cross-section and the brace member 19 that supports the chute 14 and upper bowl 18 preferably has a hollow interior 26 to reduce the total weight that must be supported by the lower bowl 22 and its base 13.

The serving piece 11 is used for serving crispy breakfast cereal in the form of flakes or toasted bits with milk and insuring that the cereal does not become soggy in the milk as the mixture is eaten. Specifically, and with reference to FIG. 3, the lower bowl 12 expediently is partially filled with milk 27 and the upper bowl 18 is filled with cereal 28 in the form, for example, of crispy flakes. A measured portion of the cereal 28 chosen to be quickly consumable in two or three bites can then be urged with a spoon 29 or similar eating utensil from the upper bowl 18 into the upper end 17 of the sloped chute 14. The slope of the chute then causes the measured portion of cereal to slide under the influence of gravity down the chute 14 and into the milk 27 within the lower bowl 12. The measured portion of cereal is thus transferred from the upper bowl 18 to the lower bowl 12 down the sloped chute 14.

Sugar, fruit or the like can then be added to the cereal within the lower bowl 12 if desired whereupon the measured portion of cereal is eaten from the lower bowl 12 in the usual way. Once this measured portion has been consumed, a subsequent measured portion can be transferred from the upper bowl, down the chute and into the milk for further consumption with this process continuing until all of the cereal within the upper bowl 18 has been consumed.

With the just described configuration, a supply of cereal 28 is contained in its crispy form within the upper bowl 18 until just before it is consumed whereupon only a measured quickly consumable portion of the cereal is transferred from the upper bowl into the milk within the lower bowl 12. The cereal can then be eaten from the lower bowl before it absorbs sufficient milk to become soggy. The consumer is thus assured of fresh crispy cereal no matter how leisurely a breakfast he enjoys. Further, since the cereal does not stand within the milk for long periods of time prior to consumption, no special coatings or other treatment of the cereal is required to retard its absorption of milk. Healthier, more natural untreated cereals, which traditionally absorb milk at a high rate, can thus be fully enjoyed with the present invention without the risk of its becoming soggy in milk and without the waste often associated with the discard of soggy cereal experienced in the past.

The invention has been described in terms of a preferred embodiment. It will be obvious to those of skill in the art, however, that many modifications, deletions and additions could be made to the preferred embodiment within the scope of the invention. The upper bowl 18, for example, might be supported directly above the lower bowl 12 with a transfer means other than a chute communicating between the bowls. Further, the upper bowl 18 might not be elevated with respect to the lower bowl at all, although such configuration is considered preferable for inducing crispy cereal to slid down the chute 14 under the influence of gravity. Finally, the configurations and shapes of the bowls and chute of the preferred embodiment could well be varied without affecting their function, the illustrated shapes being only preferred expedients. These and many other modifications might be made to the preferred embodiment by skilled artisans without departing from the spirit and scope of the invention as set forth in the claims.

What is claimed is:

1. A serving piece for serving cereal and preventing it from becoming soggy in milk with said serving piece comprising:

a first bowl for receiving milk with said first bowl being adapted to be supported upon a surface in a food containing orientation;

an elongated cereal chute mounted at one end to and communicating with said first bowl;

said cereal chute extending upwardly and outwardly from said first bowl when said first bowl is supported in its food containing orientation; and a second bowl for receiving cereal with said second bowl being mounted to and communicating with the other end of said cereal chute, whereby cereal contained in the second bowl can be urged in measured quickly edible portions from the second bowl down the chute and into milk within the first bowl from where it can be consumed before becoming soggy.

2. A serving piece comprising:

a first reservoir;

a second reservoir; and transfer means communicating between said first and said second reservoirs for selectively transferring food from said second reservoir into said first reservoir.

3. A serving piece as claimed in claim 2 wherein said first reservoir comprises a first bowl configured to be supported upon a surface in a food containing orientation.

4. A serving piece as claimed in claim 3 wherein said second reservoir comprises a second bowl.

5. A serving piece as claimed in claim 4 wherein said transfer means comprises an elongated chute having a first end portion and a second end portion with said chute communicating at its first end portion with said first bowl and at its second end portion with said second bowl.

6. A serving piece as claimed in claim 5 wherein said chute extends upwardly and outwardly from said first bowl when said first bowl is supported in its food containing orientation upon a surface and wherein said second bowl is supported by said chute in an elevated position relative to said first bowl.

7. A serving piece as claimed in claim 5 wherein said first bowl is formed with a supporting base and wherein said base is weighted to secure said first bowl in its food containing orientation upon a surface and to counteract the weight of said second bowl and said chute.

8. A serving piece comprising a lower bowl having a weighted base for supporting said lower bowl in a food containing orientation upon a surface, an elongated sloped chute mounted to and communicating at its lower end with said lower bowl and extending upwardly and outwardly therefrom, and an upper bowl mounted to and communicating with the upper end of said chute, whereby crispy cereal contained in the upper bowl can be urged in measured quickly consumable portions down the chute and into milk contained within the lower bowl from where it can be consumed before becoming soggy in the milk.

9. A method of preventing cereal from becoming soggy in milk before being consumed with said method comprising the steps of (a) containing milk in a first container;

(b) containing cereal in a second container; and (c) transferring cereal in measured quickly consumable portions from the second container into the first container along a transfer means communicating between the containers whereby each cereal portion can be consumed before it becomes soggy and a next successive container can be transferred into the first container for consumption.

10. The method of claim 9 and where in step (c) the transfer means is an elongated sloped chute communicating at one end with the first container and communicating at its other end with the second container.

* * * * *